US011407615B2

(12) United States Patent
Laughton et al.

(10) Patent No.: US 11,407,615 B2
(45) Date of Patent: Aug. 9, 2022

(54) ELEVATOR GUIDE

(71) Applicant: ELEVATOR SAFETY COMPANY, Owings Mills, MD (US)

(72) Inventors: Andrew James Laughton, Ellicott City, MD (US); Jeffrey Lachica Geroso, Baltimore, MD (US); Tyler Stine, Ellicott City, MD (US); Douglas Hamilton, III, Baltimore, MD (US); Antonio Alexander Witt, Thronton, CO (US)

(73) Assignee: ELEVATOR SAFETY COMPANY, Owings Mills, MD (US)

( * ) Notice: Subject to any disclaimer, the term of this patent is extended or adjusted under 35 U.S.C. 154(b) by 169 days.

(21) Appl. No.: 16/793,293

(22) Filed: Feb. 18, 2020

(65) Prior Publication Data

US 2021/0253397 A1 Aug. 19, 2021

(51) Int. Cl.
*B66B 7/04* (2006.01)

(52) U.S. Cl.
CPC ..... *B66B 7/046* (2013.01); *B66B 7/048* (2013.01)

(58) Field of Classification Search
CPC ..... B66B 7/04; B66B 7/046; B66B 7/047; B66B 7/048; B66B 7/10; F16H 2007/0486; F16H 2007/088; F16H 2007/0891; F16H 57/0426; F16H 57/0428; B60G 11/14
See application file for complete search history.

(56) References Cited

U.S. PATENT DOCUMENTS 1,916,365 A * 7/1933 Dunlop ..... B66B 7/047 187/409
2,057,118 A * 10/1936 Sanford ..... B66B 7/048 187/409
2,253,820 A * 8/1941 Spiro ..... B66B 7/046 187/410

(Continued)

OTHER PUBLICATIONS

Model C brochure, five (5) pages publicly available at least as early as Feb. 17, 2019 (NPL1).

(Continued)

*Primary Examiner* — Minh Truong
(74) *Attorney, Agent, or Firm* — Merek, Blackmon & Voorhees, LLC

(57) ABSTRACT

An elevator guide having a bracket and a hub moveable relative to the bracket. A face arm and opposing side arms are connected to a cylindrical portion of the hub each having at least one guide member (e.g., wheel) or a gib assembly connected to the cylindrical portion of the hub. A self-centering hub spring is preferably provided. An adjustable hub spring force adjustment member for independently varying the spring force of the hub spring and an adjustable stop for independently adjusting the distance the hub can move away from an elevator rail are provided. The hub preferably includes one or more lubricant receiving members configured to enhance distribution of a lubricant. One or more components of the guide include one or more initial set-up markings that readily allow a user to position one or more components in an optimal set-up position to significantly reduce assembly time. The hub and hub spring are preferably configured to prevent the hub spring from falling out of the hub.

19 Claims, 10 Drawing Sheets

(56) References Cited

U.S. PATENT DOCUMENTS

| | | | | |
|---|---|---|---|---|
| 2,601,503 | A * | 6/1952 | Cornish | B66B 7/048<br>187/409 |
| 3,000,225 | A * | 9/1961 | Taylor | B25D 16/006<br>74/22 R |
| 7,562,749 | B2 | 7/2009 | Race, Sr. et al. | |
| 2005/0279585 | A1 | 12/2005 | Race, Sr. et al. | |
| 2015/0321885 | A1 | 11/2015 | Laughton | |
| 2017/0057785 | A1 | 3/2017 | Geroso et al. | |
| 2020/0317472 | A1 | 10/2020 | Laughton et al. | |

OTHER PUBLICATIONS

Model A brochure, five (5) pages publicly available at least as early as Feb. 17, 2019 (NPL2).
Slide Guide brochure, six (6) pages publicly available at least as early as Feb. 17, 2019 (NPL3).
Express 6 brochure, five (5) pages publicly available at least as early as Feb. 17, 2019 (NPL4).
Express 3 brochure, five (5) pages publicly available at least as early as Feb. 17, 2019 (NPL5).

* cited by examiner

ELEVATOR GUIDE

FIELD OF THE INVENTION

The present invention is directed to elevator guides used for guiding the movement of a component (e.g., an elevator car and/or counter weight) along elevator guide rails installed in a shaft or hoist way of a building structure wherein the elevator guides include a hub moveable in an internal bore or cavity of a guide mounting bracket.

BACKGROUND OF THE INVENTION

Elevator guides typically guide movement of a component (e.g., an elevator car or a counterweight) along a pair of opposing elevator guide rails located in a shaft or hoist way of a building structure. It is customary to employ a plurality of elevator guides to guide movement of the component along the elevator guide rails as the component moves in a shaft or hoist way of a building structure. Typically, two of the elevator guides are secured to the upper portion of the component in such a manner as to engage the corresponding elevator guide rails and two elevator guides are secured to the lower portion of the component to engage the corresponding guide rails. Typically, elevator guides have a plurality of rollers/wheels or other guide components that engage and travel along the corresponding elevator guide rail.

One type of elevator guide employs a hub moveable in an internal cavity or bore of an elevator guide support bracket connected to a corresponding portion of the elevator component. The hub slides in an inner cavity or bore of the bracket. A hub spring controls relative movement of the hub and bracket. Preferred forms of the present invention are designed to significantly improve hub and bracket type elevator guides. Preferred forms of the present invention include an adjustable spring force member and an adjustable stop that are independently adjustable so that the hub spring force can be adjusted without affecting a setting of the adjustable stop and the adjustable stop can be independently adjusted to vary the amount of relative motion between the hub and bracket permitted by the elevator guide without affecting a setting of the adjustable spring force member. Another preferred form of the present invention provides a self-centering hub spring that centers the hub spring in an internal cavity or bore of the hub when a force is applied to the hub spring. A further preferred form of the present invention provides a hub spring bore or cavity and a hub spring that are configured to facilitate or ensure centering of the hub spring and significantly reduce or eliminate the hub spring rubbing against wall portions of the hub spring bore or cavity as the hub spring expands or contracts. A further preferred form of the present invention includes a hub having a spring receiving or insertion opening which requires the hub spring to be threaded through the spring receiving or insertion opening to insert the hub spring in the hub spring bore or cavity to prevent the hub spring from falling out of the hub spring bore or cavity during assembly, disassembly or other manipulation of the elevator guide or components thereof. Another preferred form of the present invention includes a hub that includes one or more lubricant receiving members configured to enhance distribution of a lubricant around and along the hub. Still another preferred form of the present invention includes initial set-up markings that readily allow a user to position one or more components (e.g., the hub, spring force adjustment member and/or an adjustable stop) of the elevator guide in an optimal initial set-up position.

OBJECTS AND SUMMARY OF THE INVENTION

An object of the present invention is to provide a novel and unobvious elevator guide that guides movement of a component (e.g., an elevator car or a counterweight) along a pair of opposing elevator guide rails located in a shaft or hoist way of a building structure.

Another object of a preferred embodiment of the present invention is to provide an elevator guide that includes a self-centering hub spring that centers itself in a hub spring cavity or bore.

A further object of a preferred embodiment of the present invention is to provide an elevator guide having an adjustable spring force member and an adjustable stop each of which can be adjusted independent of the other.

Yet another object of a preferred embodiment of the present invention is to provide an elevator guide with a hub having one or more lubricant receiving members configured to enhance distribution of a lubricant around and along a portion of the hub.

Still another object of a preferred embodiment of the present invention is to provide one or more initial set-up markings on one or more components of the elevator guide (e.g., hub, adjustable spring force member and/or adjustable stop) which allow an individual to readily position the one or more components in an optimal initial set-up position.

Yet still another object of a preferred embodiment of the present invention is to provide an elevator guide which significantly reduces or eliminates friction caused by rubbing of a hub spring on a wall portion of the hub spring cavity or bore when the hub spring is expanded or contracted.

Another object of a preferred embodiment of the present invention is to provide an elevator guide having a spring and hub spring cavity or bore each having tapered ends to facilitate proper positioning of the hub spring in the hub spring cavity or bore.

A further object of a preferred embodiment of the present invention is to provide a hub of an elevator guide having a spring receiving/insertion opening that requires the hub spring to be threaded through the spring receiving/insertion opening to prevent the hub spring from falling out of the hub when the hub or elevator guide are handled by an individual, e.g., during assembly, disassembly or other manipulation.

Still a further object of a preferred embodiment of the present invention is to provide an a hub spring and a spring force adjustment member configured such that the spring force adjustment member engages an outer end of the hub spring to eliminate or significantly reduce extension of the spring force adjustment member into the hub spring.

A further object of a preferred embodiment of the present invention is to provide an adjustable spring force member spring force concentrically aligned with the hub spring cavity or bore and an adjustable stop vertically offset from the adjustable spring force member.

Yet a further object of a preferred embodiment of the present invention is to provide an internal cavity of the elevator bracket that is sufficiently sized and/or configured to a portion of an adjustable stop.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, a preferred embodiment of the present invention is directed to an elevator guide configured to ride along an elevator rail having a base member and a rail member. The rail member of the elevator rail has a front face, a first side and a second side. The rail member of the elevator rail further extends substantially perpendicular to the base member of the elevator rail. The elevator guide comprises an elevator guide support bracket configured to be attached to a component that rides along one or more elevator rails. The elevator guide support bracket has an internal cavity. The elevator guide further includes a hub having a first section and a second section. The first section of the hub is connected to a guide assembly that rides along a corresponding portion of the rail member. The guide assembly includes one of the following: (i) a plurality of elevator guide arms including an elevator face guide arm and a pair of opposing elevator guide side arms, the elevator guide face arm and the pair of opposing elevator guide side arms each include at least one guide member (e.g., rollers or wheels) for engaging and riding along a corresponding portion of the rail member of the elevator rail, and (ii) a rail gib assembly. The second section of the hub is configured to move in the internal cavity of the elevator guide support bracket. The second section of the hub includes an internal spring bore for receiving a hub spring. A hub spring is configured to be disposed in the internal spring bore of the hub. A spring force adjustment member is configured to engage the hub spring when the hub spring is disposed in the internal spring bore of the hub to vary a spring force of the hub spring wherein at least one of the internal spring bore of the hub and the hub spring are configured to center the hub spring when a predetermined force is applied to an outer end of the hub spring by the spring force adjustment member.

Another preferred embodiment of the present invention is directed to an elevator guide configured to ride along an elevator rail having a base member and a rail member. The rail member of the elevator rail has a front face, a first side and a second side. The rail member of the elevator rail further extends substantially perpendicular to the base member of the elevator rail. The elevator guide includes an elevator guide support bracket configured to be attached to a component that rides on one or more elevator rails. The elevator guide support bracket has an internal cavity. The elevator guide further includes a hub having a first section and a second section. The first section of the hub is configured to be positioned closer to the elevator rail than the second section of the hub. The first section of the hub is connected to a guide assembly that rides along a corresponding portion of the rail member. The guide assembly includes one of the following: (i) a plurality of elevator guide arms including an elevator face guide arm and a pair of opposing elevator guide side arms, the elevator guide face arm and the pair of opposing elevator guide side arms each include at least one guide member (e.g., rollers or wheels) for engaging and riding along a corresponding portion of the rail member of the elevator rail, and (ii) a rail gib assembly. The second section of the hub is configured to move in the internal cavity of the elevator guide support bracket. The second section of the hub has an internal spring bore for receiving a hub spring. A hub spring is configured to be disposed in the internal spring bore of the hub. A spring force adjustment member is configured to engage the hub spring when the hub spring is disposed in the internal spring bore of the hub to vary a spring force of the hub spring. An adjustable stop is configured to be moveable relative to the elevator guide support bracket to vary a distance which the hub can move in a direction away from the elevator rail.

A further preferred embodiment of the present invention is directed to an elevator guide configured to ride along an elevator rail having a base member and a rail member. The rail member of the elevator rail has a front face, a first side and a second side. The rail member of the elevator rail further extends substantially perpendicular to the base member of the elevator rail. The elevator guide comprises an elevator guide support bracket configured to be attached to a component that rides on one or more elevator rails. The elevator guide support bracket has an internal cavity and a lubricant port. The elevator guide further includes a hub having a first section and a second section. The first section of the hub is configured to be positioned closer to the elevator rail than the second section of the hub. The first section of the hub is connected to a guide assembly that rides along a corresponding portion of the rail member. The guide assembly includes one of the following: (i) a plurality of elevator guide arms including an elevator face guide arm and a pair of opposing elevator guide side arms, the elevator guide face arm and the pair of opposing elevator guide side arms each include at least one guide member (e.g., rollers or wheels) for engaging and riding along a corresponding portion of the rail member of the elevator rail, and (ii) a rail gib assembly. The second section of the hub is configured to move in the internal cavity of the elevator guide support bracket between an innermost position and an outermost position wherein when the hub is in the innermost position the hub extends into the internal cavity of the elevator guide support bracket a distance greater than when the hub is in the outermost position. The second section of the hub has an internal spring bore for receiving a hub spring. The second section of the hub further has at least one lubricant groove formed in an exterior surface of the second section of the hub. The at least one lubricant groove is in fluid communication with the lubricant port to receive a lubricant from the lubricant port.

Still another embodiment of the present invention is directed to an elevator guide configured to ride along an elevator rail having a base member and a rail member. The rail member of the elevator rail has a front face, a first side and a second side. The rail member of the elevator rail further extends substantially perpendicular to the base member of the elevator rail. The elevator guide comprises an elevator guide support bracket configured to be attached to a component that rides on one or more elevator rails. The elevator guide support bracket has an internal cavity. The elevator guide further includes a hub having a first section and a second section. The first section of the hub is configured to be positioned closer to the elevator rail than the second section of the hub. The first section of the hub is connected to a guide assembly that rides along a corresponding portion of the rail member. The guide assembly includes one of the following: (i) a plurality of elevator guide arms including an elevator face guide arm and a pair of opposing elevator guide side arms, the elevator guide face arm and the pair of opposing elevator guide side arms each include at least one guide member (e.g., rollers or wheels) for engaging and riding along a corresponding portion of the rail member of the elevator rail, and (ii) a rail gib assembly. The second section of the hub is configured to move in the internal cavity of the elevator guide support bracket. The second section of the hub has an internal spring bore for receiving a hub spring. A hub spring is configured to be disposed in the internal spring bore of the hub. At least one adjustment member is configured to control relative movement between the hub and the elevator guide support bracket. The elevator guide further has at least one of the following: (i) an initial set-up marking formed on the hub identifying to an individual an initial set-up position of the hub relative to the elevator guide support bracket; and, (ii) an initial set-up marking formed on the at least one adjustment member identifying to an individual an initial set-up position of the adjustment member relative to the elevator guide support bracket.

DETAILED DESCRIPTION OF THE PREFERRED EMBODIMENTS OF THE INVENTION

The preferred forms of the invention will now be described with reference to FIGS. 1-10. The appended claims are not limited to the preferred forms and no term and/or phrase used herein is to be given a meaning other than its ordinary meaning unless it is expressly stated that the term and/or phrase shall have a special meaning.

FIGS. 1-10

Referring to FIGS. 1 to 9, preferred forms of an elevator guide will be described and discussed with components thereof illustrated in one of many possible configurations. The preferred embodiments illustrate elevator guides that utilize three support arms each having upper and lower rollers/wheels that are attached to and guide movement of a component (e.g., an elevator car or counterweight) along opposing elevator rails. However, guide members other than rollers/wheels can be used. Further, the number of rollers/wheels or other guide members can be altered as desired.

Figure 10:
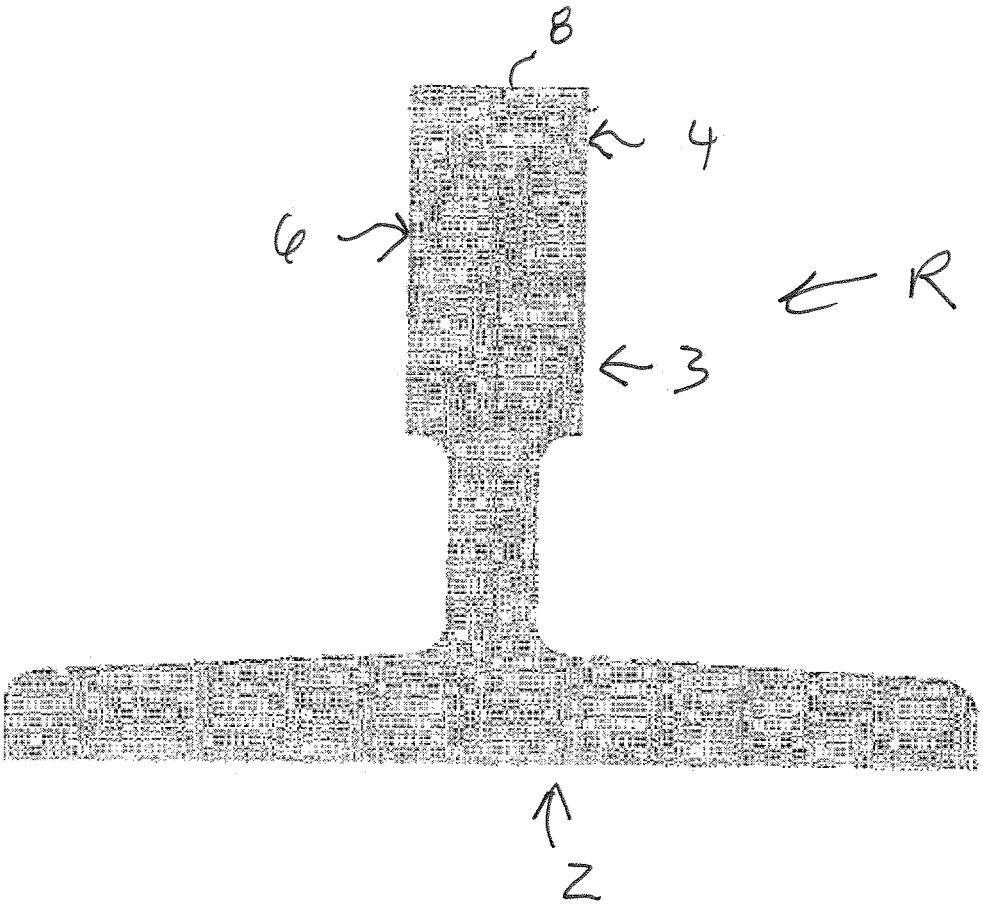
FIG. 10 is a sectional view of an elevator rail.

FIG. 10 illustrates an example of an elevator rail R that the preferred elevator guides ride along. Elevator rail R includes a base member 2 and rail member 3. Rail member 3 extends perpendicular or substantially perpendicular to the base member 2. Rail member 3 includes opposing side faces 4 and 6 and a front face 8 extending between side face 4 and side face 6.

Referring to FIGS. 1 to 9, elevator roller guide A is configured to be mounted about and ride on elevator rail R. Elevator roller guide A includes an elevator guide support bracket B having a base plate or member 10 including a plurality of bolt receiving openings (e.g. four bolt receiving openings) 12 and a groove or slot 14 configured to receive a corresponding portion of rail member 3. The bolt receiving openings 12 receive bolts (not shown) to detachably connect guide A to an elevator component that rides along or on elevator rails. Bracket B includes a stem or arm 16 extending upwardly from plate 10 and a cylindrical section 18 having an internal cavity 20. Section 18 includes a bore 22 extending through section 18 to communicate with internal cavity 20. A lubricant fitting or port 26 has a lower end that extends into bore 22 to connect port 26 to section 18. Port 26 can be detachably connected to section 18 by any suitable means including but not limited to a friction fit. Further, port 26 could be permanently fixed to section 18 by any suitable means. A lubricant can be introduced into internal cavity 20 of section 18 through port 26 and bore 22. An opening or bore 28 extends through an outer wall 30 of section 18 to communicate with internal cavity 20. Preferably, a longitudinal axis passing through a center of bore 28 is aligned with a longitudinal axis passing through a center of internal cavity 20 of section 18. An opening or bore 32 extends through an outer wall 30 of section 18 to communicate with internal cavity 20. Bore 32 is preferably offset downwardly from bore 28. Bore 32 can have a diameter which differs from the diameter of bore 28. For example, bore 32 can have a diameter that is greater than the diameter of bore 28. Plate 10, arm 16 and section 18 can be formed from a single piece of metal or other suitable material. However, plate 10, arm 16 and section 18 can be formed from two or more pieces of suitable material.

Figure 2:
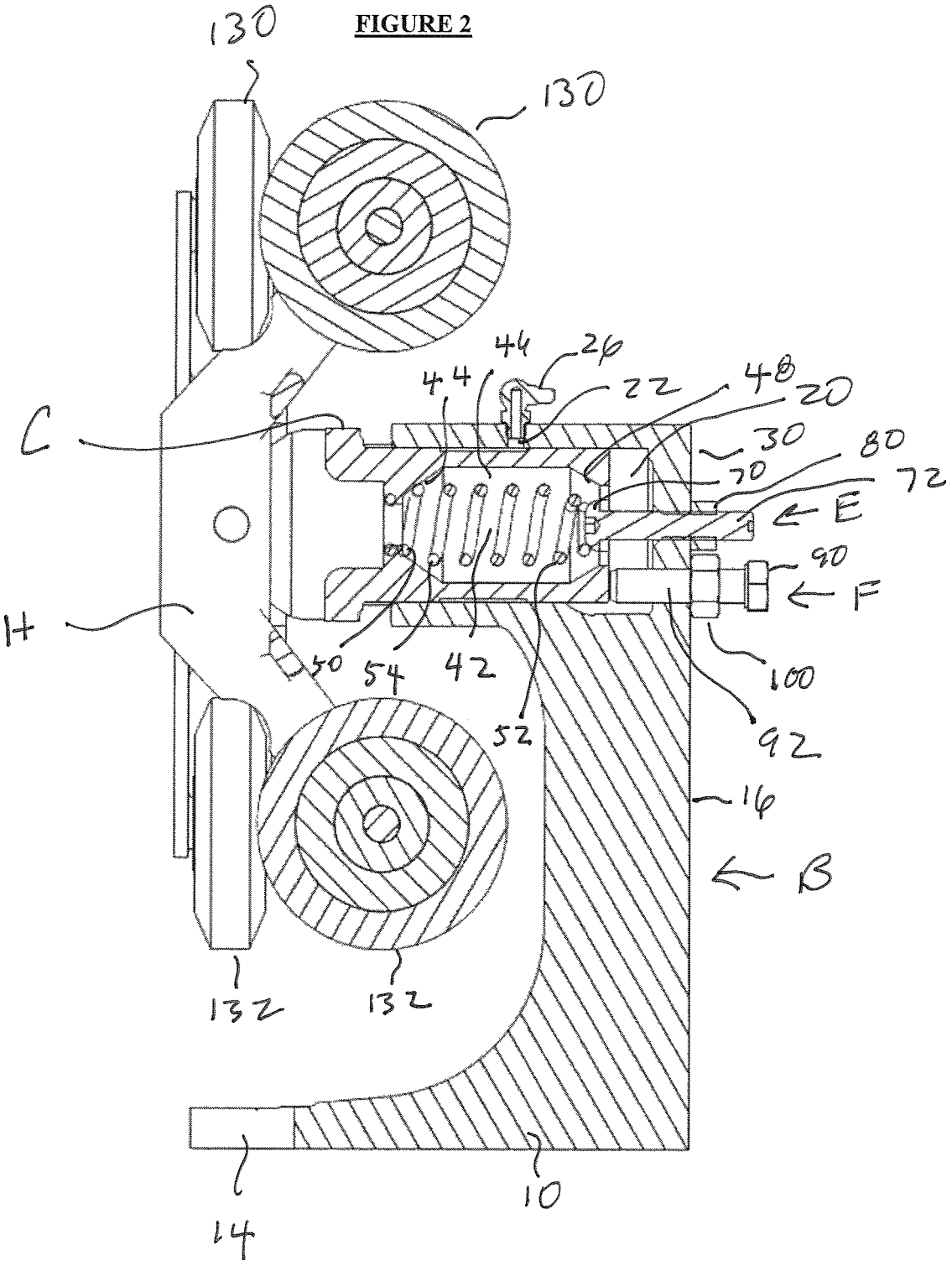
FIG. 2 is a cross-sectional view of an elevator guide formed in accordance with a preferred embodiment of the present invention.
Figure 3:
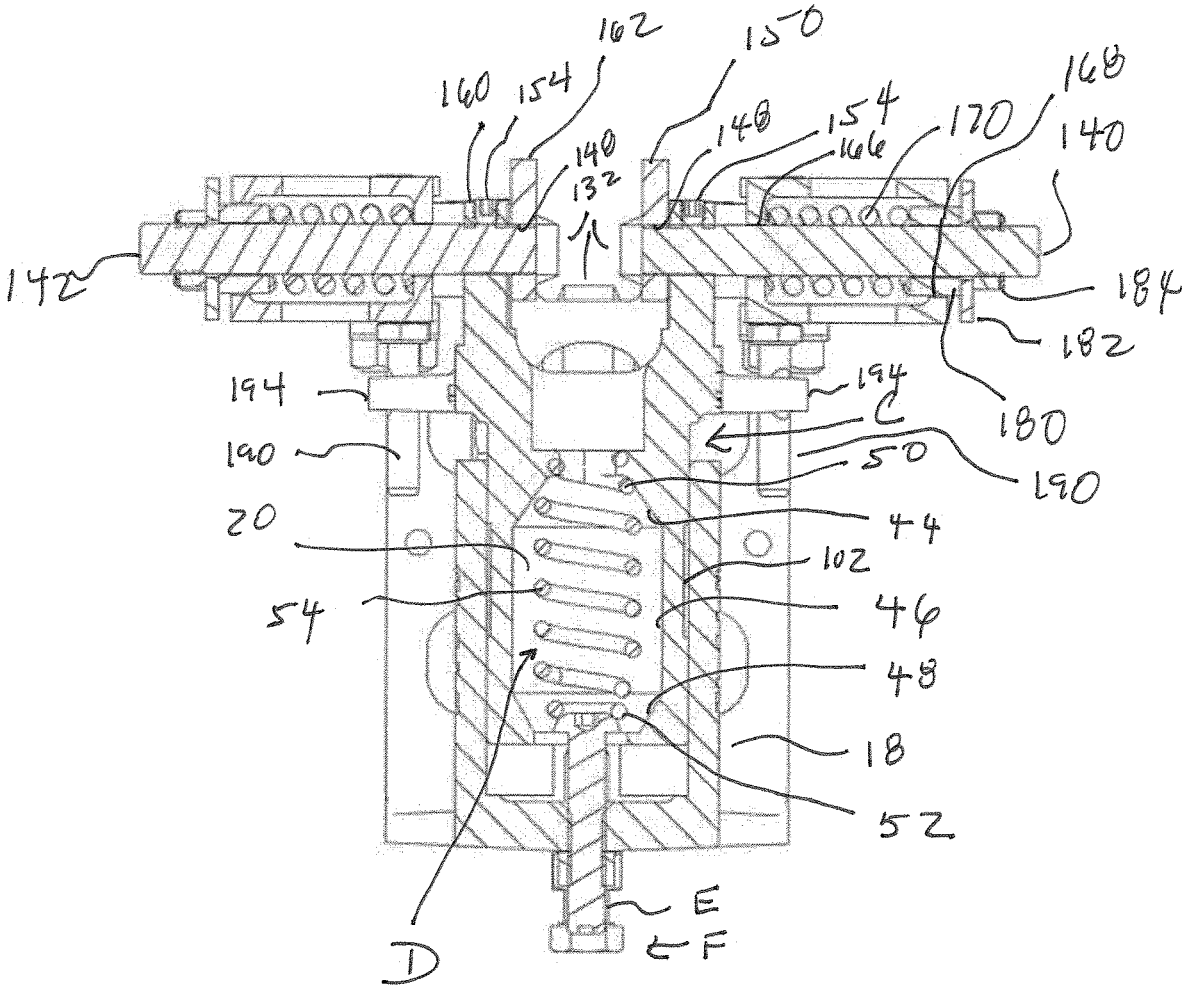
FIG. 3 is another cross-sectional view of a preferred embodiment of the present invention.

Guide A includes a hub C connected to member B in a manner which permits hub C to move relative to said member B. As seen in, for example, FIG. 3, hub C includes a cylindrical segment or section 40 which extends into internal cavity 20 of section 18 of member B. Hub C includes a hub spring receiving cavity 42. Cavity 42 has a tapered or conical section 44, a cylindrical section 46 and a tapered or conical section 48. Section 46 extends between section 44 and section 48. A hub spring E is disposed in cavity 42 to control movement of hub C relative to member B. As seen in, for example, FIGS. 2, 3 and 6, hub spring D includes inwardly tapered ends 50 and 52 and a center section 54 extending between inwardly tapered ends 50 and 52. Referring to FIGS. 2 and 3, tapered end 50 of spring D extends into tapered end 44 and tapered end 52 extends into tapered end 48.

Figure 5:
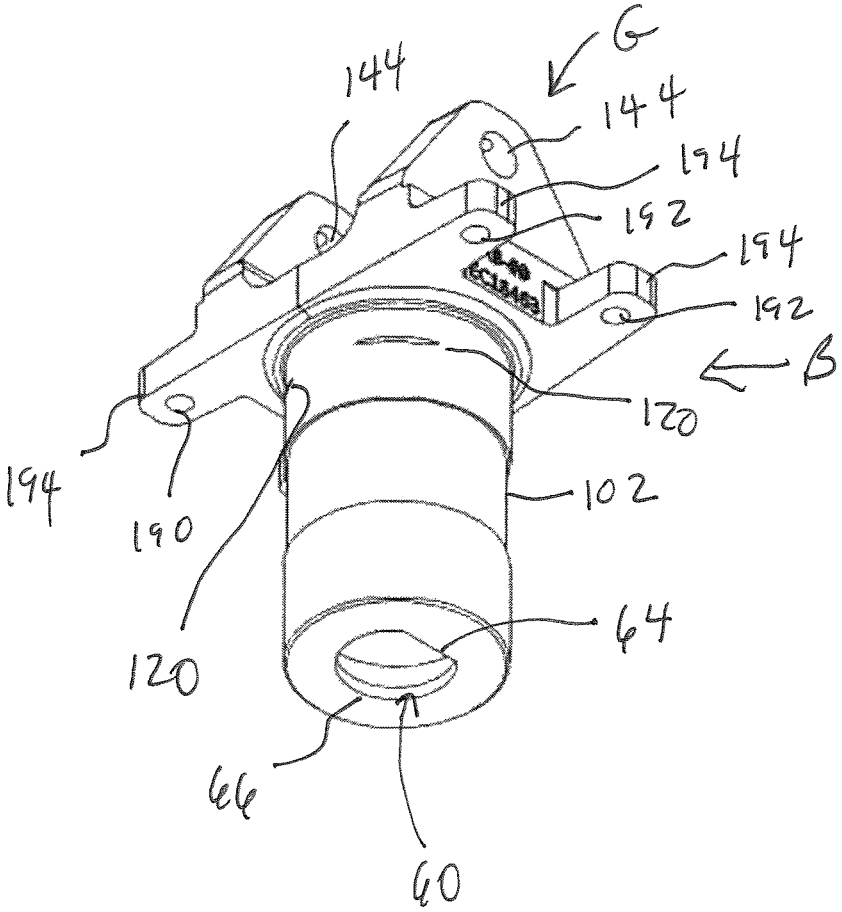
FIG. 5 is a perspective view of the hub of a preferred embodiment of the present invention taken from a different vantage point than that illustrated in FIG. 4.
Figure 6:
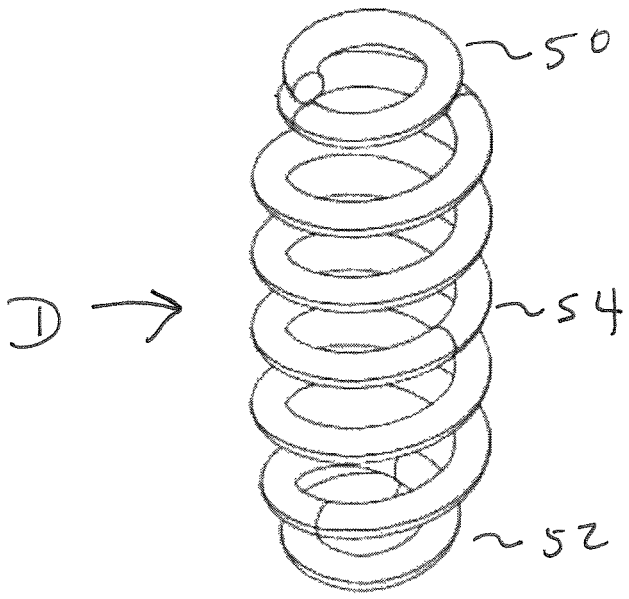
FIG. 6 is a perspective view a hub spring of a preferred embodiment of the present invention.

Referring to FIG. 5, hub C preferably has a spring receiving or insertion opening 60 formed in an outer vertically extending face 62 of hub C. Opening 60 preferably has a straight or flat peripheral segment 64 connected to an arcuate peripheral segment 66 so that opening 60 has a shape that resembles a capital "D." This configuration of opening 60 and the sizing of hub spring D, require hub spring D to be threaded through opening 60 to position spring D in cavity 42. More specifically, spring D must be rotated as it is being inserted into opening 60 and cavity 42. The configuration of opening 60 is advantageous as it holds spring D in cavity 42 and prevents or significantly reduces the likelihood of spring D falling out of cavity 42 when a user manipulates the hub C during assembly, disassembly or other manipulation of the elevator guide A components thereof, e.g., when a user removes or separates hub C from member B.

Preferably, spring D is self-centering, i.e., spring D is configured to be centered in cavity 42 when a force in applied to spring D. Tapered ends 50 and 52 of spring D and tapered ends of 44 and 48 of cavity 42 aid in the centering of spring D in cavity 42. The configuration of cavity 42 and spring D also reduce friction caused by a conventional hub spring rubbing wall portions of a conventional hub cavity. The configuration of cavity 42 and spring D also facilitate installation of spring D.

Elevator guide A further includes a spring force adjustment member E and an adjustable stop F. Spring force adjustment member E is configured to allow an individual to readily vary the force of hub spring D between a maximum spring force and a minimum spring force. Adjustable stop D allows an individual to vary the distance hub C can move away from rail R between a maximum distance and a minimum distance.

Figure 8:
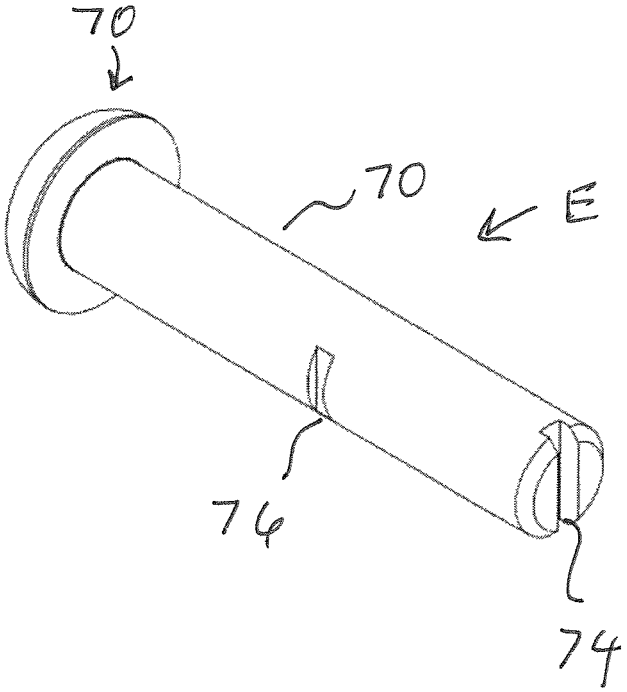
FIG. 8 is a perspective view of a spring force adjustment member (with the threads not shown) of a preferred embodiment of the present invention.

Referring to FIG. 8, member E includes an inner head 70, a shaft 72 extending outwardly from rounded or tapered head 70 and a tool receiving groove or slot 74. Shaft 72 can have external threads that are complimentary to threads that can be formed in bore 28. Shaft 72 also preferably includes an initial set-up marking 76 that readily identifies to a user an initial set-up position of member E relative to section 18 of member B. In a most preferred form, marking 76 takes the form of a groove, notch, recess, indentation or other marking formed in or on an exterior surface of shaft 72. When initially assembling the elevator guide, an individual can vertically align marking 76 with outer wall 30, to set member E in an optimal initial set-up position. Marking 76 is advantageous as the difficultly often encountered in initially setting a spring force adjustment member in a desired initial set-up position is eliminated. The shape of head 70 allows adjustment member E to readily engage tapered end 52 of hub spring D and further aids in the centering of spring D in cavity 42. Preferably, no portion of member E extends into section 54 or section 50 of spring D. Member E does not extend completely through spring D or extend into a major portion of spring D. This orientation of member E significantly reduces or eliminates friction forces caused by the hub spring rubbing on the spring force adjustment member. A nut 80 can be threaded on a threaded portion (not shown) of shaft 72 to hold member E in a desired operating position. Slot or groove 74 is configured to receive a flat head screwdriver so that an individual can rotate member E clockwise to increase the spring force of hub spring D or counterclockwise to reduce the spring force of hub spring D. However, it will be readily appreciated that element 74 can take many other shapes or forms to receive different tools including but not limited to a Phillips head screwdriver or a lug wrench. Preferably, a longitudinal axis extending through a center of member E passes through a center of spring D and a center of cavity 42, i.e., member E is concentrically aligned with spring D and cavity 42.

Figure 7:
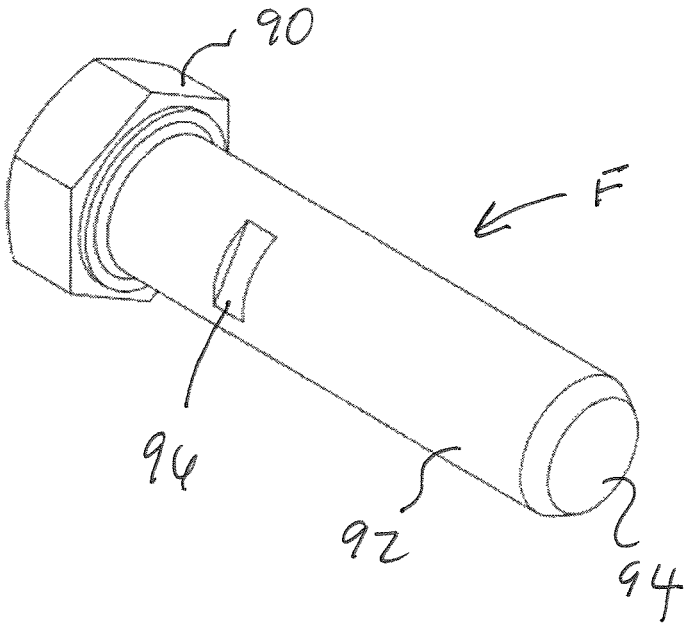
FIG. 7 is a perspective view of an adjustable stop (with the threads not shown) of a preferred embodiment of the present invention.

Referring to FIG. 7, adjustable stop F preferably includes a head 90, a shaft 92 and a hub engaging face 94. Shaft 92 can have external threads that are complimentary to threads that can be formed in bore 32. Shaft 92 also preferably includes an initial set-up marking 96 that readily identifies to a user an initial set-up position of member F relative to section 18 of member B. In a most preferred form, marking 96 takes the form of a groove, notch, recess, indentation or other marking formed in or on an exterior surface of shaft 92. When initially assembling the elevator guide, an individual can vertically align marking 96 with outer wall 30, to set member F in an optimal initial set-up position. Marking 96 is advantageous as the difficultly that may be encountered in initially setting member F to a desired or optimal initial set-up position is eliminated.

Member E and member F can be provided with a plurality of markings 76 and 96, respectively, spaced about the corresponding shaft at the same distance from an end of the corresponding shaft. Head 90 preferably takes the form of a bolt head to allow and individual to rotate member F with a wrench or socket counterclockwise or clockwise to readily vary the distance hub C can move away from rail R between a maximum distance and a minimum distance. A longitudinal axis passing through a center of member F is offset vertically (e.g., downwardly) from a longitudinal axis passing through a center of member E. A nut 100 or other device may be provided to hold member F in a desired operating position as seen in FIG. 2.

A significant advantage to members E and F of the preferred form of elevator guide A is that an individual can vary or adjust the setting of one of members E and F without adjusting or affecting the other of members E and F.

Figure 4:
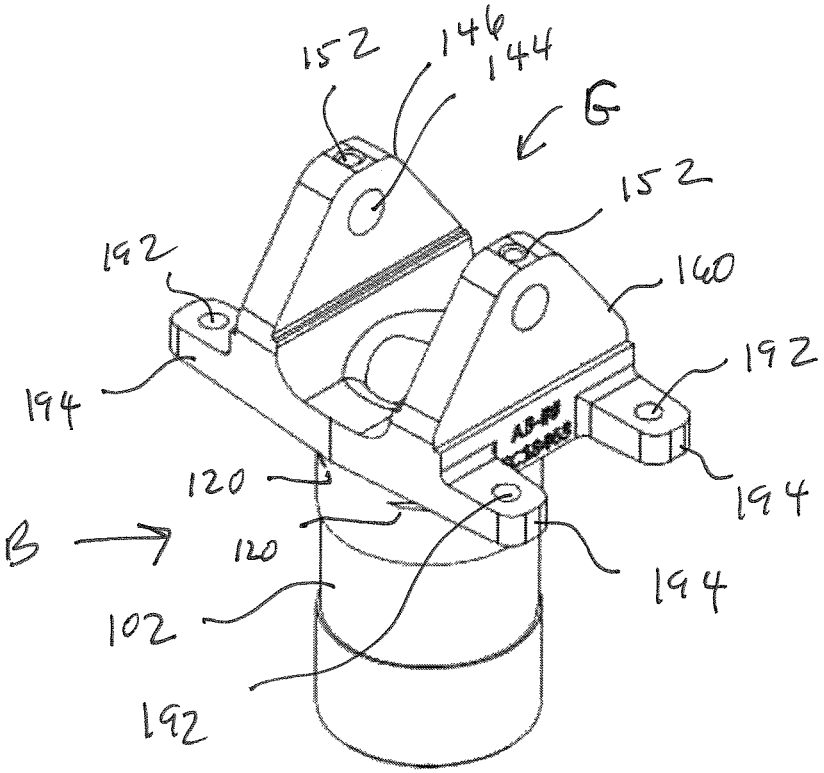
FIG. 4 is a perspective view of a hub of a preferred embodiment of the present invention.

Referring to FIGS. 4 and 5, hub C includes a lubricant receiving member 102. Member 102 can take many forms including a groove, recess or notch. Preferably, member 102 is annular to ensure that lubricant received from port 26 and bore 22 can readily travel completely around an exterior of hub C in lubricant receiving member 102. Preferably, lubricant receiving member 102 is configured such that regardless of the positioning of members E and F, at least a portion of lubricant receiving member 102 is vertically aligned with at least a portion of bore 22.

Figure 9:
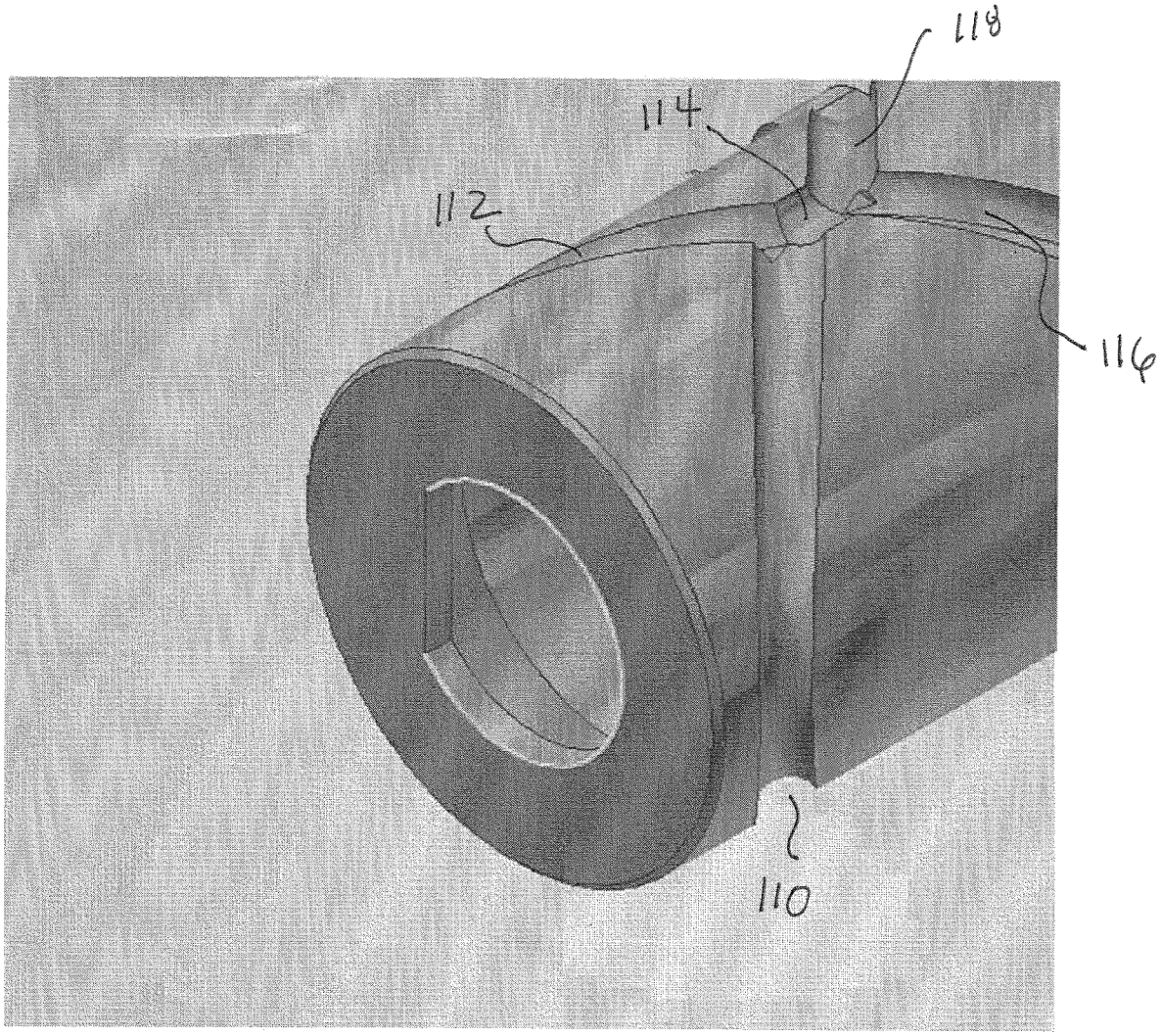
FIG. 9 is a fragmentary perspective view of another preferred form of the hub of the present invention.

Referring to FIG. 9, a plurality of lubricant receiving members may be formed in an exterior of the hub. For example, a first set of spiral or helical grooves 110 and 112 can communicate with a first end of longitudinally extending upper and lower grooves 114 (only upper groove 114 is shown) and a second set of spiral or helical grooves 116 and 118 can communicate with an opposing second end of groove 114 to allow free flow of a lubricant between grooves 110, 112, 114, 116 and 118.

Referring to FIG. 5, one or more initial set-up markings 120 can be formed in an exterior surface of hub C. In a most preferred form, the one or more markings 120 take the form of a groove, notch, recess, indentation or other marking formed in or on an exterior surface of hub C. An individual can vertically align the one or more markings 120 with the open end of section 18 that receives a portion of hub C so that hub C is properly set at an optimal initial set-up position.

Figure 1:
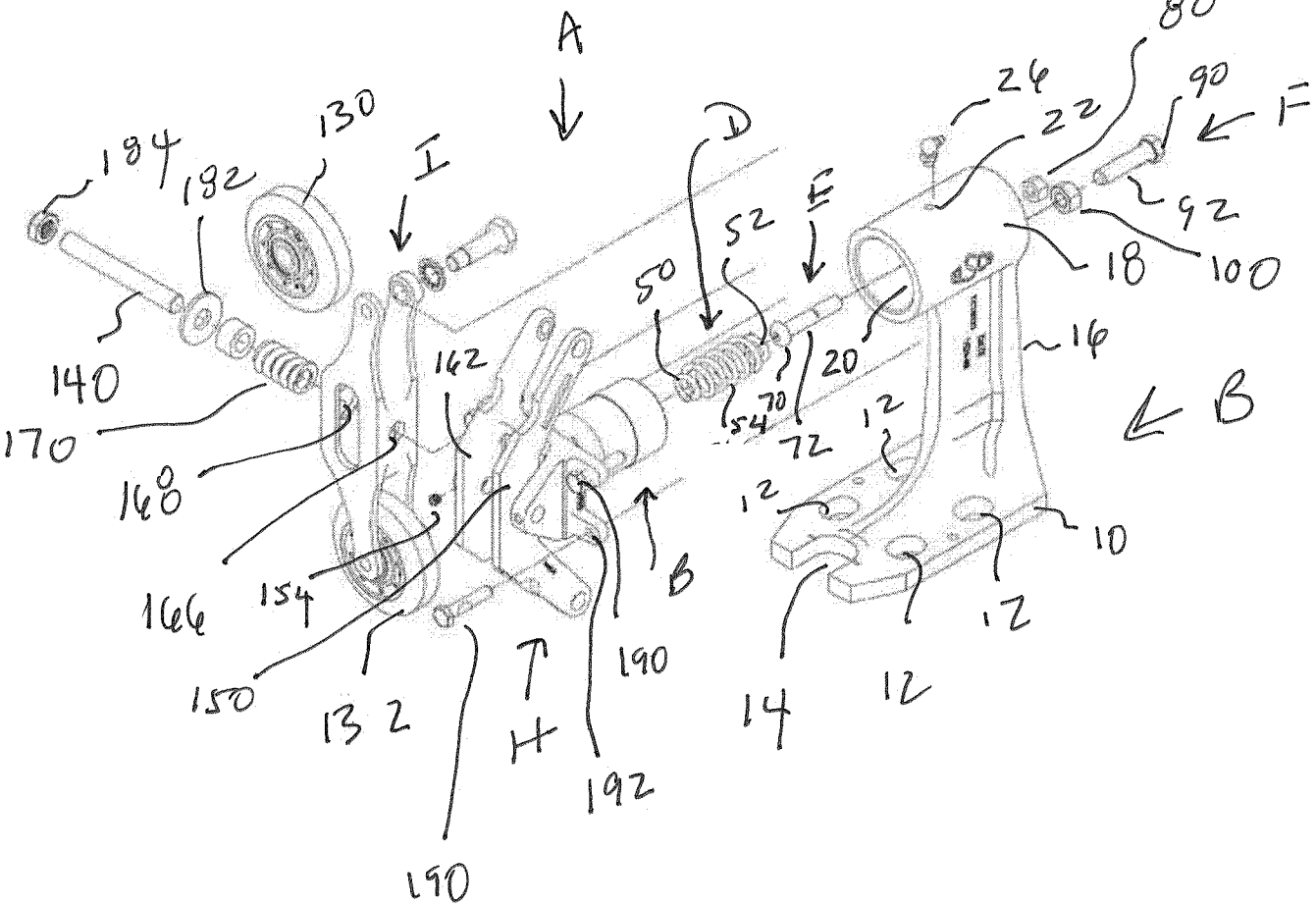
FIG. 1 is an exploded perspective view of a portion of an elevator guide formed in accordance with a preferred embodiment of the present invention. Portion of the elevator guide have been removed for purposes of better showing other portions of the elevator guide.

Referring to FIGS. 4 and 5, hub C includes an end G configured to support face arm H and opposing side arms I of elevator guide A. Each of the two opposing side arms I are preferably identical so only one of the side arms I will be described in detail. Each of arms H and I include upper and lower wheels or rollers 130 and 132, respectively. Wheels 130 and 132 of each of the arms H and I ride along a corresponding portion of rail member 3. Referring to FIGS. 1 and 3, horizontally extending shafts 140 and 142 mount face arm H to end G of hub C so that face arm H can move laterally with hub C away from and toward rail R and face arm H can pivot or rotate about shafts 140 and 142. Referring to FIGS. 1, 3 and 4, shaft 140 extends through opening 144 of flange 146 of end G of hub C and into opening 148 of leg member 150 of face arm H. Flange 146 includes an opening 152 that receives a set screw 154 which locks the shaft 140 in a particular position in opening 144 of flange 146 to prevent shaft 140 from moving laterally. Shaft 142 extends through opening 144 of flange 160 of end G of hub C and into opening 148 of leg member 162 of face arm H. Flange 160 includes an opening 152 that receives a set screw 154 which locks the shaft 142 in a particular position in opening 144 of flange 160 to prevent shaft 142 from moving laterally. Set screws 154 are shown in FIG. 3 in a position in which screws 154 do not engage the corresponding shaft. Screws 154 are turned in threaded openings 152 to engage the corresponding shaft prior to elevator guide A being used to guide an elevator component along an elevator rail R.

As is seen in FIG. 3, shaft 140 extends through opposing openings 166 and 168 formed in adjacent side arm I. A spring 170 is disposed in cavity 172 to bias the adjacent arm I in a position in which rollers 130 and 132 engage a corresponding face 6 of rail member 3. Spring 170 also allows the corresponding arm I to move laterally in a direction away from rail member 3 to compensate for irregularities in face 6 that may exist. Shaft 140 can be sized relative to the opposing openings 166 and 168 to allow the corresponding arm I to pivot or rotate. Fiber sleeve 180 serves to center the corresponding side arm I on shaft 140 and provide a lower friction surface for the corresponding arm I to slide on. A washer 182 and nut 184 hold and retain spring 170 and sleeve 180 on shaft 140. At least a portion of shaft 140 is threaded to allow an individual to adjust the force of spring 170 by turning threaded nut 184. The other side arm I is mounted about shaft 142 in a similar or identical manner to the side arm mounted about shaft 140 using the same elements as described in connection with shaft 140. Four tracking screws or bolts 190 are threaded into openings 192 of corresponding outwardly extending flanges 194 of end G of hub C. The vertically spaced tracking screws 190 depicted in FIG. 1 help to maintain vertical alignment or orientation of the corresponding side arm I (not shown in FIG. 1). Two vertically spaced tracking bolts (not shown in FIG. 1) help to maintain the vertical alignment or orientation of the side arm I shown in FIG. 1. Bolts or screws 190 can be maintained in a desired position by any suitable means including but not limited to a nut mounted on bolts 190.

While the end of hub C closet to the elevator rail R is depicted as connected to or including a guide assembly having arms H and I to guide movement along the elevator rail, this end of hub C could alternatively take the form of a gib assembly of a slide guide with the cylindrical portion of hub C including one or more of the improvements set forth herein connected to the form of any known or subsequently developed gib assembly including but not limited to the gib assemblies of any of ELSCO's slide guides.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

We claim:

1. An elevator guide configured to ride along an elevator rail having a base member and a rail member, the rail member of the elevator rail having a front face, a first side and a second side, the rail member of the elevator rail further extending substantially perpendicular to the base member of the elevator rail, the elevator guide comprising:

(a) an elevator guide support bracket configured to be attached to a component that rides on one or more elevator rails, said elevator guide support bracket having an internal cavity;

(b) a hub having a first section and a second section, said first section of said hub being configured to be positioned closer to the elevator rail than said second section of said hub, said first section of said hub being connected to a guide assembly that rides along a corresponding portion of the rail member;

said second section of said hub being configured to move in said internal cavity of said elevator guide support bracket, said second section of said hub having an internal spring bore for receiving a hub spring;

(c) said hub spring configured to be disposed in said internal spring bore of said hub; and, (d) a spring force adjustment member configured to engage said hub spring when said hub spring is disposed in said internal spring bore of said hub to vary a spring force of said hub spring wherein at least one of said internal spring bore of said hub and said hub spring being configured to center said hub spring when a predetermined force is applied to an outer end of said hub spring by said spring force adjustment member, and wherein no portion of said elevator guide extends through said hub spring.

2. The elevator guide as set forth in claim 1, wherein:

(a) said hub spring includes a first end, a second end and a center section extending between said first end and said second end, said first end of said hub spring is positioned closer to the elevator rail than said second end of said hub spring; and, (b) said spring force adjustment member having an innermost end and an outermost end, said innermost end of said spring force adjustment member is disposed in said internal spring bore of said hub, said innermost end of said spring force adjustment member when installed in an operating position engages said second end of said hub spring.

3. The elevator guide as set forth in claim 2, wherein:

(a) said spring force adjustment member includes a head forming said innermost end of said spring force adjustment member and a shaft forming said outermost end of said spring force adjustment member, at least a portion of said head has a diameter greater than a diameter of said shaft wherein said shaft is fixed to said head such that said shaft cannot move relative to said head.

4. The elevator guide as set forth in claim 1, wherein:

(a) said internal spring bore of said hub is configured to center said hub spring when a predetermined force is applied to an outer end of said hub spring by said spring force adjustment member, said internal spring bore having a first end section, a second end section and a center section extending between said first end section and said second end section; said first end section and said second end section of said internal spring bore having a diameter less than a diameter of said center section of said internal spring bore.

5. The elevator guide as set forth in claim 4, wherein:

(a) said hub spring is configured to center said hub spring when a predetermined force is applied to an outer end of said hub spring by said spring force adjustment member, said hub spring having a first end section, a second end section and a center section extending between said first end section and said second end section; said first end section and said second end section of said hub spring having a diameter less than a diameter of said center section of said hub spring.

6. The elevator guide as set forth in claim 1, wherein:

(a) said hub includes a spring receiving opening in communication with said internal spring bore of said hub, said spring receiving opening and said hub spring being configured such that said hub spring is inserted into said internal spring bore of said hub by threading said hub spring through said spring receiving opening of said hub.

7. The elevator guide as set forth in claim 6, wherein:

(a) said spring receiving opening of said hub has an arcuate peripheral segment having a first end and a second end and a flat peripheral segment connected at one end to said first end of said arcuate peripheral segment and connected at another end to said second end of said arcuate peripheral segment such that said spring receiving opening has a non-circular shape.

8. An elevator guide configured to ride along an elevator rail having a base member and a rail member, the rail member of the elevator rail having a front face, a first side and a second side, the rail member of the elevator rail further extending substantially perpendicular to the base member of the elevator rail, the elevator guide comprising:

(a) an elevator guide support bracket configured to be attached to a component that rides on one or more elevator rails, said elevator guide support bracket having an internal cavity;

(b) a hub having a first section and a second section, said first section of said hub being configured to be positioned closer to the elevator rail than said second section of said hub, said first section of said hub being connected to a guide assembly that rides along a corresponding portion of the rail member;

said second section of said hub being configured to move in said internal cavity of said elevator guide support bracket, said second section of said hub having an internal spring bore for receiving a hub spring;

(c) said hub spring configured to be disposed in said internal spring bore of said hub;

(d) a spring force adjustment member configured to engage said hub spring when said hub spring is disposed in said internal spring bore of said hub to vary a spring force of said hub spring; and, (e) an adjustable stop configured to be moveable relative to said elevator guide support bracket to vary a distance which said hub can move in a direction away from the elevator rail wherein said adjustable stop is adjustable independent of said spring force adjustment member and said spring force adjustment member is adjustable independent of said adjustable stop, and wherein no portion of said adjustable stop extends through said spring force adjustment member.

9. The elevator guide as set forth in claim 8, wherein:

(a) an innermost end of said adjustable stop engages an innermost end of said second section of said hub.

10. The elevator guide as set forth in claim 8, wherein:

(a) a longitudinal axis extending through a center of said internal spring bore of said hub extends through a center of said spring force adjustment member.

11. The elevator guide as set forth in claim 10, wherein:

(a) the longitudinal axis extending through the center of said internal spring bore of said hub is offset vertically from a longitudinal axis extending through a center of said adjustable stop.

12. An elevator guide configured to ride along an elevator rail having a base member and a rail member, the rail member of the elevator rail having a front face, a first side and a second side, the rail member of the elevator rail further extending substantially perpendicular to the base member of the elevator rail, the elevator guide comprising:

(a) an elevator guide support bracket configured to be attached to a component that rides on one or more elevator rails, said elevator guide support bracket having an internal cavity and a lubricant port; and, (b) a hub having a first section and a second section, said first section of said hub being configured to be positioned closer to the elevator rail than said second section of said hub, said first section of said hub being connected to a guide assembly that rides along a corresponding portion of the rail member;

said second section of said hub being configured to move in said internal cavity of said elevator guide support bracket between an innermost position and an outermost position wherein when said hub is in the innermost position said hub extends into said internal cavity of said elevator guide support bracket a distance greater than when said hub is in said outermost position, said second section of said hub having an internal spring bore having a hub spring, said second section of said hub further having at least one lubricant groove formed in an exterior surface of said second section of said hub, said at least one lubricant groove is in fluid communication with said lubricant port to receive a lubricant from said lubricant port; wherein said at least one lubricant groove is an annular lubricant groove, said lubricant port is vertically aligned with a first portion of said annular lubricant groove when said hub is in said innermost position and said lubricant port is vertically aligned with a second portion of said annular lubricant groove when said hub is in said outermost position and wherein no portion of said elevator guide extends through said hub spring.

13. The elevator guide as set forth in claim 12, wherein:

(a) said at least one lubricant groove includes a plurality of lubricant grooves.

14. The elevator guide as set forth in claim 13, wherein:

(a) said plurality of lubricant grooves include a first lubricant groove and a second lubricant groove, said first lubricant groove has a first grooved portion and a second grooved portion, said first grooved portion of said first lubricant groove is positioned closer to a spring receiving opening of said hub than said second grooved portion of said first lubricant groove and said second lubricant groove has a first grooved portion and a second grooved portion, said first grooved portion of said second lubricant groove is positioned closer to a spring receiving opening of said hub than said second grooved portion of said second lubricant groove.

15. The elevator guide as set forth in claim 14, wherein:

(a) said first lubricant groove is connected to said second lubricant groove so that a lubricant can pass from the first lubricant groove into the second lubricant groove.

16. An elevator guide configured to ride along an elevator rail having a base member and a rail member, the rail member of the elevator rail having a front face, a first side and a second side, the rail member of the elevator rail further extending substantially perpendicular to the base member of the elevator rail, the elevator guide comprising:

(a) an elevator guide support bracket configured to be attached to a component that rides on one or more elevator rails, said elevator guide support bracket having an internal cavity;

(b) a hub having a first section and a second section, said first section of said hub being configured to be positioned closer to the elevator rail than said second section of said hub, said first section of said hub being connected to a guide assembly that rides along a corresponding portion of the rail member;

said second section of said hub being configured to move in said internal cavity of said elevator guide support bracket, said second section of said hub having an internal spring bore for receiving a hub spring;

(c) said hub spring configured to be disposed in said internal spring bore of said hub such that no portion of said elevator guide extends through said hub spring; and, (d) at least one adjustment member configured to control relative movement between said hub and said elevator guide support bracket; and, (e) said elevator guide further having at least one of the following:

(i) an initial set-up marking formed on said hub identifying to an individual an initial set-up position of said hub relative to said elevator guide support bracket; and, (ii) an initial set-up marking formed on said at least one adjustment member identifying to an individual an initial set-up position of said adjustment member relative to said elevator guide support bracket.

17. The elevator guide as set forth in claim 16, wherein:

(a) said at least one adjustment member includes an adjustable stop for restricting relative movement between said hub and said elevator guide support bracket.

18. The elevator guide as set forth in claim 16, wherein:

(a) said at least one adjustment member includes a spring force adjustment member configured to engage an outer end of said hub spring when said hub spring is disposed in said internal spring bore of said hub to vary a spring force of said hub spring wherein said outer end of said hub spring is spaced a distance from the elevator rail a distance greater than an inner end of said hub spring.

19. The elevator guide as set forth in claim 16, wherein:

(a) said at least one adjustment member includes an adjustable stop for restricting relative movement between said hub and said elevator guide support bracket and a spring force adjustment member configured to engage said hub spring when said hub spring is disposed in said internal spring bore of said hub to vary a spring force of said hub spring, said adjustable stop is adjustable independent of adjustment of said spring force adjustment member and said spring force adjustment member is adjustable independent of said adjustable stop.

* * * * *